United States Patent [19]

Schmidt

[11] Patent Number: 5,074,359

[45] Date of Patent: Dec. 24, 1991

[54] METHOD FOR HYDRAULIC FRACTURING CASED WELLBORES

[75] Inventor: Joseph H. Schmidt, Dallas, Tex.

[73] Assignee: Atlantic Richfield Company, Los Angeles, Calif.

[21] Appl. No.: 596,633

[22] Filed: Oct. 10, 1990

Related U.S. Application Data

[63] Continuation of Ser. No. 432,660, Nov. 6, 1989, abandoned.

[51] Int. Cl.[5] ..... E21B 43/267

[52] U.S. Cl. ..... 166/280; 166/308

[58] Field of Search ..... 166/308, 305.1, 280–282

[56] References Cited

U.S. PATENT DOCUMENTS

| | | | |
|---|---|---|---|
| 4,669,546 | 6/1987 | Jennings et al. | 166/308 |
| 4,749,038 | 6/1988 | Shelley | 166/280 X |
| 4,830,106 | 5/1989 | Uhri | 166/308 X |
| 4,834,181 | 5/1989 | Uhri et al. | 166/308 X |
| 4,850,431 | 7/1989 | Austin et al. | 166/308 |
| 4,867,241 | 9/1989 | Strubhar | 166/308 |

OTHER PUBLICATIONS

Yew, C. H. et al., On the Fracture Design of Deviated Wells, SPE Paper 19722, Soc. Pet. Engr., 64th Annual Tech. Conf. San Antonio, Oct. 8–11, 1989.

*Primary Examiner*—Ramon S. Britts
*Assistant Examiner*—Roger J. Schoeppel
*Attorney, Agent, or Firm*—Michael E. Martin

[57] ABSTRACT

A hydraulic fracturing method for earth formations which are penetrated by inclined wellbores wherein the near wellbore region which exhibits the maximum tensile stress in response to hydraulic pressure in the wellbore is determined, and cased wellbores are perforated at the point of maximum tensile stress resulting from fracture initiation. The fracture is subsequently propagated and propped open by proppant-laden fluids having progressively increasing proppant concentrations so that the near wellbore region of the fracture is held propped open to maintain sufficient conductivity between the main fracture body and the wellbore.

9 Claims, 2 Drawing Sheets

METHOD FOR HYDRAULIC FRACTURING CASED WELLBORES

This application is a continuation, of application Ser. No. 07/432,660, filed Nov. 6, 1989.

BACKGROUND OF THE INVENTION

1. Field of the Invention

The present invention pertains to a method for hydraulically fracturing an earth formation from an inclined or deviated wellbore to improve the conductivity of the fracture.

2. Background

In the production of fluids from subterranean formations, it has been a long-standing practice to hydraulically fracture the formation from a wellbore to enhance the flow of fluids from the formation into the wellbore. It has been recognized for some time that the propagation of a fracture in an earth formation proceeds generally in a plane which is normal to the direction of the minimum principal stress existing in the formation. In a majority of cases, in deep wellbores, the direction of this stress is horizontal and, accordingly, the fracture is a generally vertical propagating fracture in a plane perpendicular to the minimum stress. In certain shallow wells, depending on formation characteristics, the fracture may propagate in a generally horizontal plane if the compressive stresses are greater in the horizontal rather than the vertical direction.

For generally vertical wellbores, the overall fracture length and direction of propagation can be easily controlled. For example, in a cased wellbore, if the direction of the minimum principal stress is determined, the wellbore casing may be perforated along a line which lies in a plane which is normal to the direction of the minimum stress. Thus, the injection of fluids through the perforations will initiate a series of fractures which will eventually link up and become a single vertically extending fracture, generally in a plane normal to the minimum stress.

In recent years the search for hydrocarbon reservoirs has required the drilling of many inclined or deviated wellbores which intersect the direction of the minimum principal stress in the formation at an angle other than 90 degrees. The development of suitable fractures extending from such wellbores has not been particularly successful. Some wells have been drilled with a so-called "S" shape, that is, starting out vertical, then being inclined, and finally resuming a generally vertical direction in the zone that is to be fractured in order to avoid problems associated with poor fracture propagation from deviated or inclined wells. U.S. Pat. No. 4,669,546 to Jennings, Jr. et al and issued June 2, 1987 describes a method for improving vertical fractures of inclined wellbores by providing a series of in-line openings along the low side of the wellbore casing. This technique provides suitable fractures in only very limited cases, that is, primarily where the wellbore extends in the plane of the direction of the maximum principal stress. Other factors often dictate the direction of a wellbore and the likelihood of having a wellbore extending in such a preferred direction is very low.

Certain efforts have been made to improve on the method described in the Jennings, Jr. et al patent such as described in the paper published by the Society of Petroleum Engineers, Richardson, Texas, under No. SPE 19722 entitled "On Fracture Design of Deviated Wells" by C. H. Yew, Joseph H. Schmidt and Yi Li. This paper prescribes, among other things, the optimum angle with respect to the wellbore axis for providing perforations in cased wellbores to initiate fractures which will provide greater conductivity.

However, in the development of wellbore fractures from inclined wells, it has been discovered that the near wellbore formation stresses tend to reduce the fracture dimensions and the fracture does not grow in length or height until it has turned to lie in the plane which is normal to the direction of the minimum principal stress. Even though the technique described in the above-referenced paper optimizes the location of casing perforations for cased wellbores, the plane of the fracture will still undergo some degree of turning as it grows in the vertical direction. Accordingly, the fracture in the near wellbore region is of smaller cross-sectional area, may be subject to relatively high closing stress and may form a point of throttling or choking of the flow of fluids between the formation and the wellbore.

One problem which has been discovered is that if the fracture is not suitably held open by the injection of a proppant, the fracture will reclose in the near wellbore region and force proppant and fluids into the main body of the fracture upon relaxation of pumping pressure. This will result in costly refracturing operations to reopen the fracture and possibly result in a poor completion. Accordingly, the present invention is directed to an improved method of completing a fracturing operation in a subterranean formation where such fracturing is carried out primarily from deviated or inclined wellbores and which operation overcomes some of the problems associated with prior art efforts to fracture formations from inclined wellbores.

SUMMARY OF THE INVENTION

The present invention pertains to an improved method for fracturing subterranean formations wherein such fractures extend from so-called deviated or inclined wellbores. In accordance with one important aspect of the present invention, the region of the earth formation is determined which will, at the wellbore wall, provide the maximum tensile stress to be exerted on the formation during a fracturing operation. Then the fracture is initiated in a direction which corresponds to the point of maximum tensile stress and the fracture is propped open by a progressive treatment process which prevents reclosing of the fracture, particularly in a zone adjacent the wellbore and corresponding to the zone of maximum stress.

In accordance with another important aspect of the present invention, the location of the maximum tensile stress in the formation to be seen during fracture initiation is determined using an improved method of referencing the particular point on the wellbore with respect to the highest point on the wellbore at which a perforation is to be provided, in the case of cased wellbores. Such particular point will provide for initiation of a fracture which will turn at the lowest rate into the vertical fracture plane which is perpendicular to the minimum in situ horizontal stress, thereby providing a propped region which is less likely to forcibly reclose than in fractures which are initiated in more highly stressed regions of the wellbore. This fracturing technique coupled with the injection of proppant materials in such a way that the fracture will screen out at the outer reaches of the fracture with respect to the wellbore assures that the fracture will not reclose in a region directly adjacent the wellbore.

The above-noted improvements in hydraulic fracturing according to the present invention together with other superior aspects thereof will be further appreciated by those skilled in the art upon reading the detailed description which follows in conjunction with the drawing.

DESCRIPTION OF PREFERRED EMBODIMENTS

Figure 1:
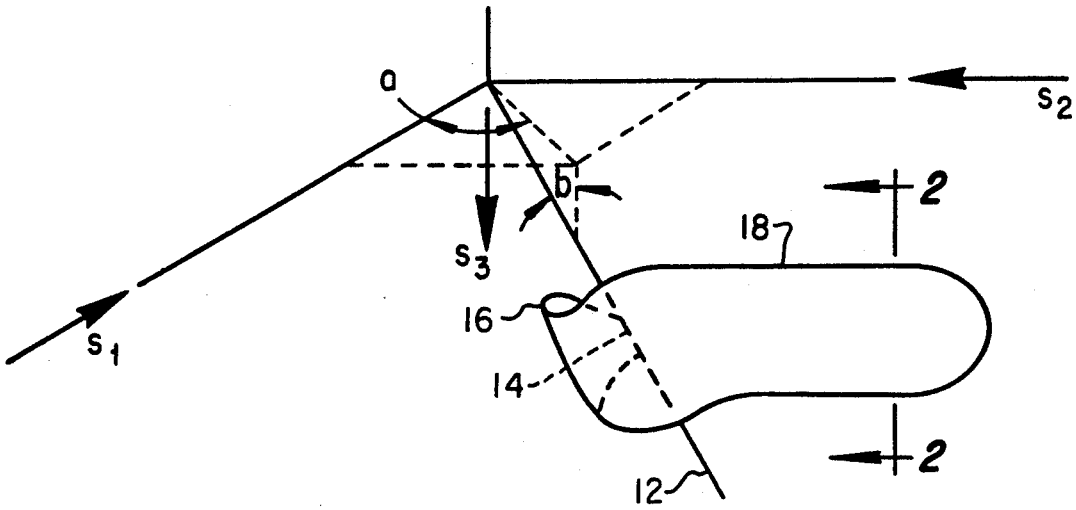
FIG. 1 is a schematic diagram illustrating the growth of a hydraulic fracture from a deviated or inclined wellbore and in relation to the direction of the principal stresses in the formation region being fractured.

Referring to FIG. 1 there is illustrated a schematic diagram of an inclined or deviated wellbore generally designated by the numeral 12. The wellbore 12 is illustrated as penetrating an earth formation at an angle b with respect to the vertical and with respect to the tensor of a compressive stress $s_3$ comprising the principal vertical stress due to the weight of the earth, primarily. In a majority of deep wellbores, the compressive stresses may be resolved into the vertical stress $s_3$ and principal horizontal compressive stresses comprising a maximum stress $s_2$ and a minimum stress $s_1$. It is well established that the propagation of a hydraulic fracture in most earth formations having the stress field illustrated in FIG. 1, generally proceeds along a plane which is normal to the minimum principal stress $s_1$. Accordingly, it has been determined that it is important to place the location of wellbore perforations, for cased wellbores, in a position which will facilitate the propagation of a hydraulic fracture while minimizing the tendency for the fracture to close or pinch off in an area directly adjacent to the wellbore perforation. For purposes of illustration, the wellbore 12 is shown inclined at the angle b with respect to the direction of the vertical compressive stress $s_3$ and at an angle a with respect to the direction of the minimum principal horizontal compressive stress $s_1$. Those skilled in the art will recognize that, in some shallow or unusual formations, the minimum compressive stress may be other than a generally horizontal stress. For purposes of this discussion the wellbore may also be "inclined" with respect to the formation region of interest but extended in a vertical direction.

Figure 2:
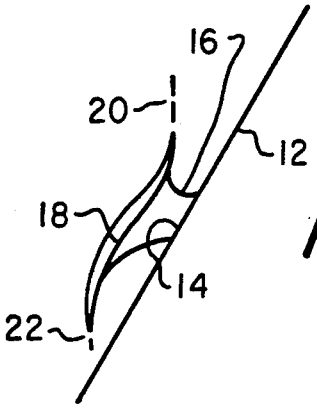
FIG. 2 is a view of a portion of the diagram of FIG. 1 taken along the line 2—2 of FIG. 1.

For purposes of illustration, the wellbore 12 is indicated to have had initiated a fracture in the region 14 which propagates outward while seeking to extend itself in a plane which is normal to the direction of the horizontal stress $s_1$. Accordingly, the fracture initially propagates away from the wellbore at 14 and undergoes a turning effort to develop a curved portion 16 and eventually a somewhat planar, vertical portion 18 which is generally normal to the direction of the stress $s_1$. FIG. 2 illustrates the final directions of extension of the fracture portion 18 such as at 20 and 22.

Figure 3:
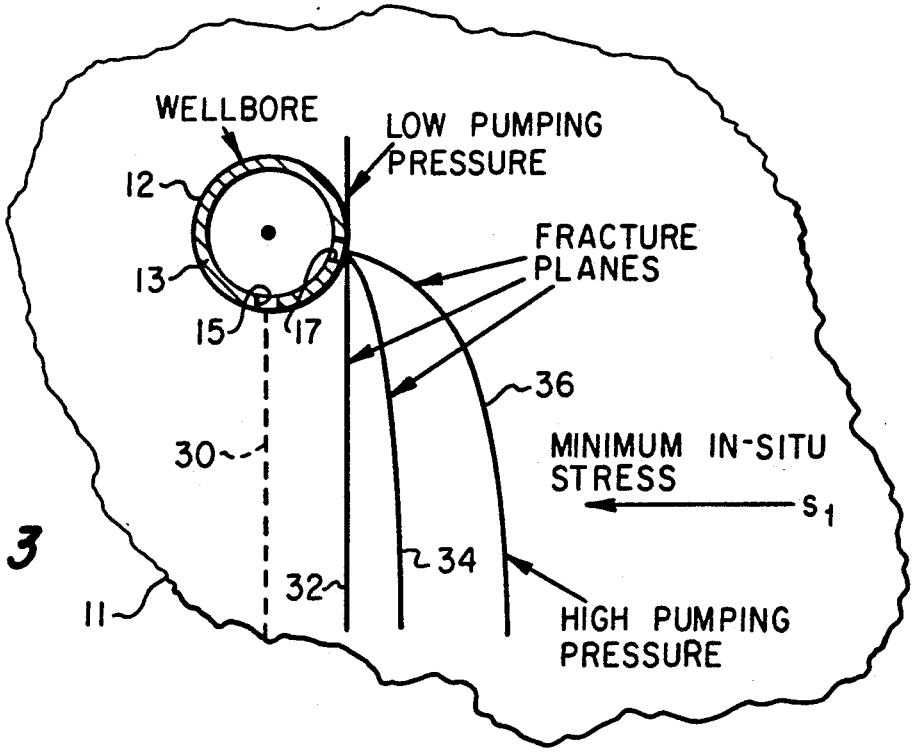
FIG. 3 is a schematic diagram illustrating the turning of a hydraulic fracture from a vertically extending wellbore into the plane normal to the minimum in situ horizontal stress as a function of the hydraulic pumping pressure.

If the perforations in the wellbore casing, for example, are not aligned in such a way that the hydraulic pressure is exerted on the formation in the region of maximum tensile stress in the wellbore wall, then the fracture plane may extend at substantially higher turning rates for a given bottom-hole pressure exerted on the formation. FIG. 3 illustrates various perforation alignments and wherein various hydraulic pumping pressures are utilized to give different fracture plane configurations for the case where the wellbore 12 is vertically extending (angle b=0). In FIG. 3 the wellbore 12 is shown having a casing 13 with perforations 15 and 17 formed therein. The direction of the minimum in situ compressive stress $s_1$ is also indicated in FIG. 3. The view of FIG. 3 is taken normal to the central longitudinal wellbore axis at the point of perforation into the formation 11. As indicated by the dashed line 30, a fracture initiated from the perforation 15 could propagate radially outwardly from the wellbore since it is normal to the direction of the minimum in situ stress $s_1$. However, fractures 32, 34 or 36, if initiated from the perforation 17, would progress at the directions indicated in accordance with the hydraulic pumping pressure. The fracture plane 32 is not desirable since the width of the fracture and the sharp turn in the fracture from the point of the perforation 17 into the formation is very abrupt and this is a very convenient pinch-off or closure point of the fracture. Accordingly, the respective directions of fracture propagation, as indicated by the fractures 32, 34 and 36, are enhanced by high hydraulic pumping pressure so that the single fracture emanating from the perforation 17 initially extends somewhat radially outwardly from the perforation 17 and then begins its turn into the plane which is normal to the minimum in situ stress as indicated by the fracture 36, for example.

Moreover, if the perforations are not located in a region wherein the maximum tensile stress in the wellbore wall will occur as a result of hydraulic pressure exerted on the formation from the wellbore, the fracture will migrate away from the perforations but immediately turn to seek the region of the formation which will break down first. This configuration of fracture may not be conducive to the flow of fluids therethrough and not be amenable to being easily kept open by the placement of a proppant in the fracture. Still further, such deviated fractures, if not propped open in accordance with the present invention, will tend to close at the point directly adjacent the wellbore perforations and squeeze any fluid or proppant in that portion of the fracture into the main body of the fracture. Accordingly, the fracture will be pinched off from communicating with the wellbore and will be devoid of proppant in the region of the fracture directly adjacent the wellbore.

With the foregoing in mind, the problem then becomes one of determining the proper placement of perforations in a cased wellbore for initiation and propagation of a hydraulic fracture when the wellbore is inclined or deviated from the vertical. The orientation of the in situ stresses may be determined from known techniques such as the study of fault maps from previous exploration activity, extracting core samples from the formation region of interest, preferably through the wellbore, or by other measurement techniques including instruments that may be placed in the wellbore in the region of interest before the wellbore is cased. For convenience in locating a perforating gun to place the perforations at the proper location in the wellbore, the so-called "high" side of the wellbore should be referenced since this position may be easily determined by wellbore orientation instruments. The aforementioned publication by the Society of Petroleum Engineers (SPE Paper No. 19722 by C. H. Yew, Joseph A. Schmidt and Yi Li) describes equations for solving the location of the maximum principal tensile stress with respect to its orientation from the so-called high side of the wellbore.

Figure 4:
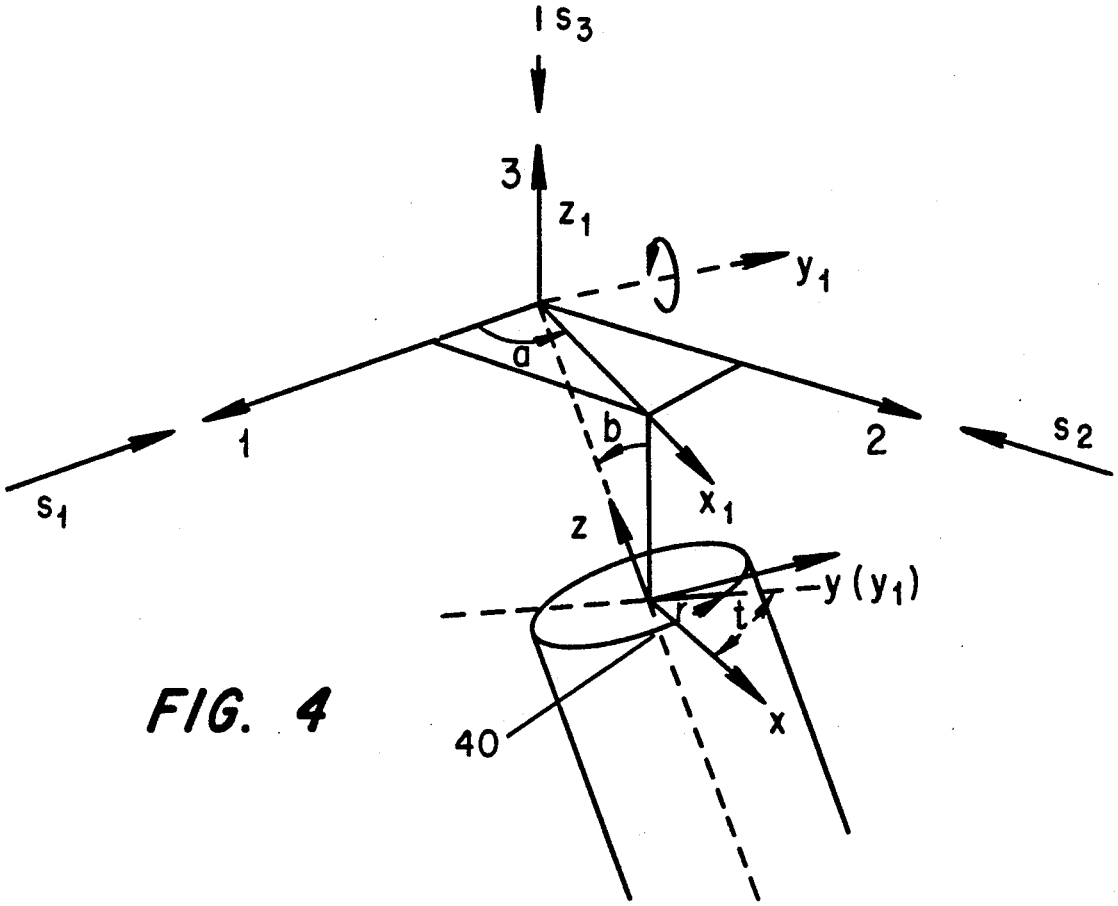
FIG. 4 is a schematic diagram illustrating a transformed coordinate system for determining the point at which a fracture should occur from a deviated well and in relation to the directions of the in situ compressive stresses in the formation.

FIG. 4 is a diagram indicating the coordinate system which is used in developing the equations in the aforementioned publication, and in particular, the equation for the maximum tensile stress in the formation surrounding the wellbore at the point of interest as a function of the angle t which is measured from the transformed coordinate system illustrated in FIG. 4, that is the x, y, z coordinate system wherein the z axis is the wellbore axis, the x axis is an axis normal to the wellbore axis and passing through the highest point on the surface of the wellbore at any given position along the wellbore and indicated by the numeral 40 in FIG. 4. The angle t is the angle of the maximum tensile stress that will be experienced in the formation in the region to be perforated with respect to the x axis and the maximum tensile stress, $s_m$, as a function of the angle t, may be expressed by the following equation:

$$s_m(t) = \frac{s_z + s_t}{2} + \sqrt{\left(\frac{s_t - s_z}{2}\right)^2 + s_{tz}^2} \quad (1)$$

where $s_z$ equals the normal stress parallel to the wellbore axis at the wellbore surface, $s_t$ equals the circumferential (hoop) stress around the wellbore surface, and $s_{tz}$ equals the shearing stress in the surface of the wellbore.

The angular orientation ($t_o$) of the initial fracture is determined by differentiating equation (1) with respect to t, viz., $$\frac{ds_m}{dt} = 0$$

The stresses in the coordinate system of the wellbore (x, y, z) may be determined from the equations set forth in the aforementioned publication based on actual measurement of core samples, sonic logs, data fracs, or other standard techniques.

When the angle $t_o$ has been determined, the wellbore 12 may be perforated at the angle $t_o$ with respect to the x axis, which axis passes through the highest point on the wellbore and thus makes it relatively easy to orient the perforating gun. Fracture operations may then be carried out in a manner which, in accordance with the present invention, minimizes the possibility of the fracture closing in the area adjacent the wellbore and which area is subject to high stresses and tends to pinch off or close and squeeze proppant from that region into the main body of the fracture if the fracture has not been properly prepared.

As previously discussed, in general, higher compressive stresses exist around a deviated wellbore resulting from a misalignment of the wellbore relative to the in situ principal stresses. This situation does not present a serious problem during fracture operations provided the fracture intersects a long enough length of wellbore. The fracture density required for initiating a substantially continuous fracture which is developed from the intersection of a series of mini-fractures extending from the wellbore perforations may be obtained from the procedure described in the aforementioned publication, SPE Paper No. 19722. However, once pumping of the fracturing fluid ceases, the higher stressed region around the wellbore tends to close off the fracture, squeezing the fracture fluid and its proppant into the main body of the fracture, and thus resulting in a restriction in fracture conductivity immediately adjacent the wellbore perforations. By packing the main body of the fracture with proppant in a preferred manner which reduces the volume of the fracture that can receive the highly stressed proppant-laden fluid disposed in the region of the fracture near the wellbore, this proppant-laden fluid remains in such region and a highly conductive propped width of fracture near the wellbore is retained after fluid leak-off.

An example of a treatment process which results in packing of the main fracture body to prevent squeezing the proppant and fluid away from the highly stressed region of the formation adjacent the wellbore is given hereinbelow.

EXAMPLE

A well is drilled into a producible formation such as the Prudhoe Bay Oil Field, Alaska, to a depth of approximately 10,000 feet with the wellbore forming an angle to the vertical in the region of interest of approximately 34°. The formation region of interest is cased with a 5 ½ inch production liner. In situ stress measurements indicate that the optimum angle t for placement of the casing perforations is approximately 30° counterclockwise from the "high side" of the wellbore looking top to bottom. This angle is selected by making the calculations referenced in equations 1 and 2 and from the procedure described in SPE Publication No. 19722. Calculations of perforation spacing from the above-noted publication indicate that the casing should be perforated with four perforations per foot at 180° phasing along the line which, together with the x axis of FIG. 4, subtends the angle t. This perforation density and orientation is designed to assure that two fracture wings are provided with maximum wellbore intersection.

An initial injection rate is prescribed of 40 barrels per minute for a so-called pre-pad stage and which develops a relatively large radius of curvature near the wellbore. A "slick water" fluid is chosen to reduce pressure drop down the wellbore tubing and resulting in the highest possible injection rate. The large radius of curvature of the initial portion 16 of the fracture aids in minimizing the loss of fracture conductivity near the wellbore as a result of the initial fracture plane realigning itself normal to the minimum in situ horizontal stress. Moreover, the higher radius of curvature also reduces pressure losses during treatment. A total of 80 barrels is pumped during the so-called pre-pad pumping stage.

The pre-pad treatment is followed by an injection of approximately 270 barrels of clean fluid without proppant to open the main body of the fracture such as the portion 18, 20, 22 referenced in FIG. 1. This fluid may include a mixture of 100 mesh corn starch or other fluid loss additives to provide a total volume of approximately 320 barrels.

The pad injection is followed by the injection of first stage of proppant comprising a quantity of approximately 50 barrels of fracturing fluid laden with a total of 2000 pounds of proppant. The proppant is preferably an intermediate strength, bauxite type sold under the trademark INTERPROP and is injected together with the fluid in a slurry at a rate of approximately 20 barrels per minute.

Figure 5:
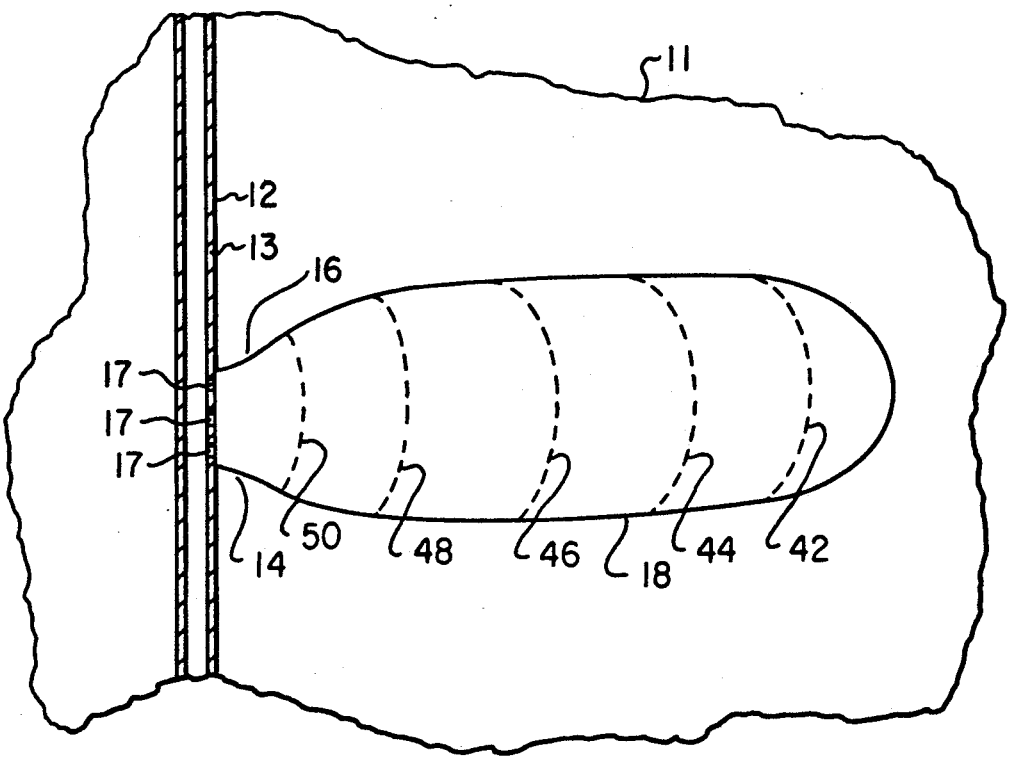
FIG. 5 is a planar development of a fracture formed in accordance with the present invention.

This stage is followed by the injection of a second stage of proppant-laden fracturing fluid in the amount of about 50 barrels of fluid having a quantity of about 3800 pounds of proppant mixed therein and pumped at a rate of approximately 15 barrels per minute. Successive stages of 100 barrels of fluid are pumped each having quantities of about 14,000 pounds of proppant and 19,000 pounds of proppant, respectively, and wherein both stages are pumped at a rate of 15 barrels per minute. A final stage of approximately 400 barrels of proppant-laden fluid is pumped having approximately 99,000 pounds of proppant mixed into 296 barrels of clean fluid and pumped at a rate of 15 barrels per minute. FIG. 5 illustrates the proppant injection or staging as indicated by the dashed lines 42, 44, 46, 48 and 50. Actually the regions of the fracture between the lines 42, 44, 46, 48 and 50 will eventually become densely packed with proppant as a result of fluid leak-off into the formation. In the view of FIG. 5, the fracture has been developed into a planar arrangement for convenience of viewing although the fracture might take a course similar to that illustrated in FIG. 1 for a single wing fracture. The opposite wing of the fracture is not illustrated in FIGS. 1 or 5 in the interest of clarity and conciseness.

The aforementioned procedure provides a fracture which is packed or screened out and which minimizes the portion of the fracture in which width reduction will occur by progressively increasing the proppant density per unit volume of pumped fluid in successive stages of injection of the fracture fluid in a deviated wellbore fracture of the type described herein. If the near wellbore stresses tend to force the proppant-laden fluid into the main body of the fracture, this action will be retarded and the region of the fracture adjacent the wellbore will remain suitably propped open. The above-mentioned fracture was carried out with a fluid of the delayed cross-linked water-based type.

Although a preferred embodiment of a method of the present invention has been described herein, those skilled in the art will recognize that various substitutions and modifications may be made to the method described without departing from the scope and spirit of the invention as recited in the appended claims.

What is claimed is:

1. A method of hydraulically fracturing a cased wellbore in an earth formation comprising the steps of:

determining the angle with respect to the wellbore axis and a reference point on the circumference of the wellbore which will provide for initiation of a hydraulic fracture in said formation which will turn with the largest radius of curvature into a fracture plane normal to the minimum in situ stress in said formation;

perforating the wellbore casing at said angle with respect to said reference point;

initiating a hydraulic fracture in said formation by pumping a liquid through said perforation and into said formation to force the initiation of a fracture in said formation at a point which develops the highest tensile stress in said formation in relation to increasing the hydraulic pressure in said wellbore;

extending said fracture by pumping a relatively proppant-free quantity of liquid to propagate said fracture and form a pad of liquid in said fracture; and pumping fluid into said fracture with progressively increasing quantities of proppant per unit volume of pumped fluid and in successive discrete stages of increasing proppant density to provide a propped portion of said fracture in the near wellbore region of said fracture which will prevent reclosing of said fracture in said near wellbore region.

2. The method set forth in claim 1 wherein:

said fracture is propped by injecting in plural stages quantities of proppant-laden liquid wherein the concentration of proppant in liquid in a second stage is approximately twice the proppant concentration of a first stage.

3. The method set forth in claim 2 wherein:

the concentration of proppant in a final stage is at least twice the concentration of proppant in said second stage.

4. The method set forth in claim 2 wherein:

the concentration of proppant in a third stage is at least three times the concentration of proppant in said second stage.

5. The method set forth in claim 4 wherein:

proppant is pumped into said fracture in a fourth stage wherein the concentration of proppant in said fluid is at least four times the concentration of proppant in said second stage.

6. The method set forth in claim 5 wherein:

proppant-laden fluid is pumped into said fracture in a fifth stage and the concentration of proppant in said fluid in said fifth stage is at least four times the concentration of proppant in said fourth stage.

7. A method of hydraulically fracturing a cased wellbore in an earth formation comprising the steps of:

determining the angle with respect to the wellbore axis and a reference point on the circumference of the wellbore which will provide for initiation of a hydraulic fracture in said formation which will turn with the largest radius of curvature into a fracture plane normal to the minimum in situ stress in said formation;

perforating the wellbore casing at said angle with respect to said reference point;

initiating a hydraulic fracture in said formation by pumping a liquid through said perforation and into said formation to force the initiation of a fracture in said formation at a point which develops the highest tensile stress in said formation in relation to increasing the hydraulic pressure in said wellbore;

extending said fracture by pumping a relatively proppant-free quantity of liquid to propagate said fracture and form a pad of liquid in said fracture; and pumping fluid into said fracture with progressively increasing quantities of proppant per unit volume of pumped fluid to provide a propped portion of said fracture in the near wellbore region of said fracture which will prevent reclosing of said fracture in said near wellbore region.

8. A method of fracturing an earth formation penetrated by a cased wellbore which intersects a plane containing the tensor of the minimum in situ compressive stress at an angle greater than 0° less than 90°, said method comprising the steps of:

determining the angle with respect to the wellbore axis and a reference point on the circumference of the wellbore which will provide for initiation of a hydraulic fracture in said formation which will turn with the largest radius of curvature into a fracture plane normal to the direction of said minimum compressive stress;

perforating the wellbore casing at said angle with respect to said reference point;

pumping hydraulic fracturing fluid into said wellbore and through said perforation to initiate a fracture in said region which begins approximately at the point of maximum tensile stress exerted on said formation in response to increasing the hydraulic pressure in said wellbore;

continuing the injection of fluid to propagate said fracture sufficiently such that said fracture turns through an initial near wellbore region into said fracture plane which is normal to the direction of said minimum in situ stress; and pumping proppant-laden fracturing fluid into said fracture with progressively increasing concentration of proppant per unit volume of fluid so that the near wellbore region of the fracture is, upon cessation of pumping, propped open sufficiently to maintain conductivity between said wellbore and the main body of said fracture extending in said fracture plane normal to said minimum compressive stress.

9. A method of fracturing a formation penetrated by a cased wellbore which intersects a plane containing the tensor of the minimum in situ compressive stress in said formation at an angle greater than 0° and less than 90°, said method comprising the steps of:

determining an angle which lies in a plane which is normal to the wellbore axis in a region of interest of said formation and which angle is subtended by the point of maximum tensile stress in said formation at said wellbore in response to hydraulic fracturing of said formation and a reference point on said wellbore;

perforating the wellbore casing along a line which substantially intersects said point of maximum tensile stress;

pumping hydraulic fracturing fluid into said wellbore and through said perforation to initiate a fracture in said region of interest and which begins approximately at said point of maximum tensile stress;

continuing the injection of fluid to propagate said fracture sufficiently such that said fracture turns through an initial near wellbore region into a plane which is normal to the direction of the minimum in situ stress; and pumping proppant-laden fracturing fluid into said fracture so that the near wellbore region of the fracture is, upon cessation of pumping, propped open sufficiently to maintain conductivity between said wellbore and the main body of said fracture extending in said plane normal to said minimum in situ stress.

* * * * *